US007488242B2

(12) United States Patent
Gringer et al.

(10) Patent No.: US 7,488,242 B2
(45) Date of Patent: Feb. 10, 2009

(54) SANDING APPARATUS WITH MOLDED ELASTOMERIC PAD

(75) Inventors: Donald Gringer, New York, NY (US); Yuan Fang Cheng, Forrest Hills, NY (US)

(73) Assignee: Allway Tools, Inc., Bronx, NY (US)

( * ) Notice: Subject to any disclaimer, the term of this patent is extended or adjusted under 35 U.S.C. 154(b) by 29 days.

(21) Appl. No.: 11/079,770

(22) Filed: Mar. 14, 2005

(65) Prior Publication Data

US 2006/0205331 A1 Sep. 14, 2006

(51) Int. Cl.
*B24B 23/00* (2006.01)

(52) U.S. Cl. ..... 451/344; 451/354; 451/524

(58) Field of Classification Search ..... 451/344, 451/354, 356, 523, 524, 525
See application file for complete search history.

(56) References Cited

U.S. PATENT DOCUMENTS 4,516,360 A 5/1985 Gringer et al.
4,516,361 A 5/1985 Gringer
5,018,314 A 5/1991 Fushiya et al.
5,605,500 A * 2/1997 Matechuk ..... 451/456
5,634,843 A * 6/1997 Liu ..... 451/344
6,095,911 A * 8/2000 Edens ..... 451/524
6,712,680 B2 * 3/2004 Pellegrin ..... 451/354
6,988,940 B1 * 1/2006 Taylor ..... 451/354
7,011,573 B2 * 3/2006 McArthur et al. ..... 451/523
2005/0287937 A1 * 12/2005 Florio ..... 451/354

* cited by examiner

*Primary Examiner*—Eileen P. Morgan
(74) *Attorney, Agent, or Firm*—Gottlieb, Rackman & Reisman, P.C.

(57) ABSTRACT

A sander comprises a body member molded of polypropylene to which a soft pad member is integrally molded or directly bonded thereto. Preferably, the material comprising the pad member is of a thermoplastic elastomer material, such as Santoprene®. Significantly, when the pad member is molded directly to the body member, the pad has internal dimensions only slightly larger than the external dimensions of the body member so that, when the body member is located within the confines of the pad member, a secure fit is formed between these two members, without any space between them. Further, the respective dimensions of the body member and pad member give the sander a thick, one-piece appearance in side and end views. The pad member may also include a plurality of openings which help provide a "spongy" effect to the user, smoothing the peaks and reaching the valleys of an uneven surface upon which the sander is utilized.

26 Claims, 10 Drawing Sheets

16
20
22
32
14
12
34
50
59
18

20
22
18
12
16
59
62
46
59
60
52
44
50
54
14
34

50
34
12
14

SANDING APPARATUS WITH MOLDED ELASTOMERIC PAD

FIELD OF INVENTION

This invention relates to improvements in the field of pole and hand sanders. More specifically, this invention involves the molding of a resilient elastomeric pad, preferably comprised of a thermoplastic elastomer, to a generally rigid body member, such as a hard plastic, preferably comprised of polypropylene. In a preferred form, said pad yields a thick and desirable appearance in addition to causing a strong connection between the pad and the body member.

BACKGROUND OF THE INVENTION

Prior art molded pole sanders such as those disclosed in U.S. Pat. Nos. 4,516,360 and 4,516,361, used for sanding down drywall and other surfaces have been in existence for many years. These sanders generally comprise a molded body member having a flat backing surface for retaining sandpaper and a handle mounting surface on the opposite side thereof that is hand held or mounted with a universal joint for engaging a threaded end of a pole. The prior art hand and pole sanders also incorporate a pair of wire clips for removably securing the ends of the sandpaper to the body member for purposes of holding the sandpaper against the backing surface.

Generally, these sanders have a number of limitations which restrict their effectiveness and versatility. Notably, prior art sanders typically do not incorporate a backing surface pad or pad member and, to the extent they do, such pads are undesirably thin and wear quickly, and since pads in prior art sanders are typically pasted on, the pads tend to loosen easily as the glue dries over time; thus they rapidly deteriorate in response to the intense character of the tasks the sanders perform. Also, to the extent padding is present in the context of prior art sanders, the pad does not fully surround the body member (i.e., at the front, rear, and sides). Since the pad member does not fully extend around the sides of the longitudinal edges of the sander, the sandpaper, which tends to be available in sizes that are wider than the backing surface and pad member, undesirably tends to roll up around the sides of the sander. Moreover, since the pad does not fully extend around the sides of the sander, the sander will easily tear the sandpaper around the hard sharp edge.

Other problems presented by prior art sanders include the decreased friction produced between the sandpaper and either the backing surface or pad member resulting from the relative "hardness" of the materials which typically comprise the backing surface or pad members. Consequentially, the sandpaper in prior art sanders is prone to tearing when the device is in use, requiring a user to change sandpaper more often than desired. Furthermore, the pad members in prior art sanders tend to wear down unevenly as well since the pads are not designed to "give" in responses to the pressure applied by a user on a given area of the pad. Moreover, pad members are typically secured to the body member with a pressure sensitive adhesive. Thus, the process for securing the pad member to the body member by the use of an adhesive is labor intensive. Using a conventional adhesive also permits the pad member to be peeled away from the body member causing an unsightly separation of the pad member and body member, possibly making the sander appear somewhat inferior to the typical user.

SUMMARY OF THE INVENTION

Accordingly, it is an object of the present invention to provide a sander with a resilient elastomeric pad member or surface that is relatively thicker, wider and more secure than those found in prior art sanders, and which includes openings or grooves in the pad, thereby providing a desirable "spongy" effect and feeling to the user when the sander is in use and simultaneously preventing sandpaper or abrasive screening utilized in connection with the sander from curling up around the edges of the sander.

A further object of the present invention is to provide a sander wherein the pad member is integrally molded to the molded body member of the sander, thus preventing the pad member from peeling away from the body member and permitting the device to be produced cost effectively.

Another object of the present invention is to provide a sander having a pad member that produces an increased amount of friction between it and the sandpaper, thus preventing the sandpaper from tearing due to "skipping" when the device is utilized.

Yet another object of the present invention is to provide a sander wherein the pad member wears evenly as the device is utilized.

Additional objectives will be apparent from the description of the invention that follows.

In its broadest aspects, the sander comprises additional features beyond those found in prior art sanders, thereby providing a greater degree of effectiveness and versatility. Preferably, the sander comprises a body member molded of generally rigid polypropylene material to which a soft backing surface pad or pad member is integrally molded or directly bonded thereto. Preferably, the material comprising the pad member is of a thermoplastic elastomer material, such as Santoprene®, or a synthetic thermoplastic rubber. Significantly, when the pad member is molded directly to the body member, the pad has internal dimensions only slightly larger than the external dimensions of the body member so that, when the body member is located within the confines of the pad member, a secure fit is formed between these two members, without any space between them.

Preferably the pad member includes a plurality of openings, e.g., grooves or apertures facing the sandpaper, which provide a "spongy" effect to the user when the device is in use. The elastomeric nature of the pad in combination with the openings, increases friction between the pad and sandpaper, thereby preventing the sandpaper from easily tearing during the course of use. Likewise, the pad wears more evenly when the device is used over time.

BRIEF DESCRIPTIONS OF THE DRAWINGS

With reference to the figures.

Figure 12A:
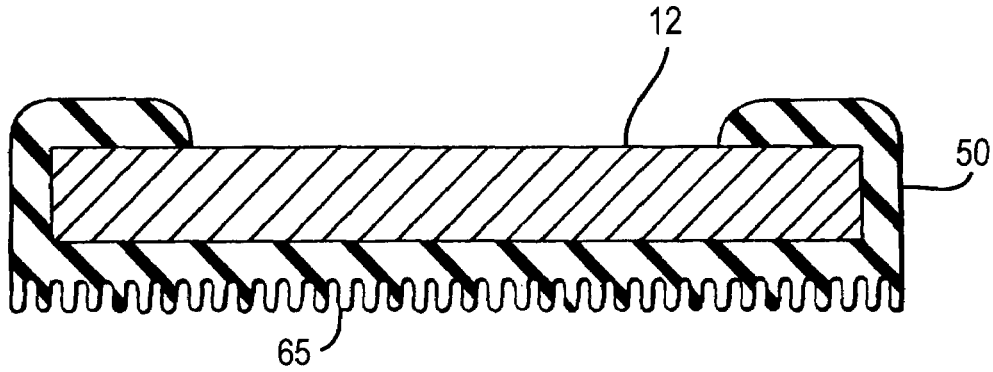
Figure 12B:
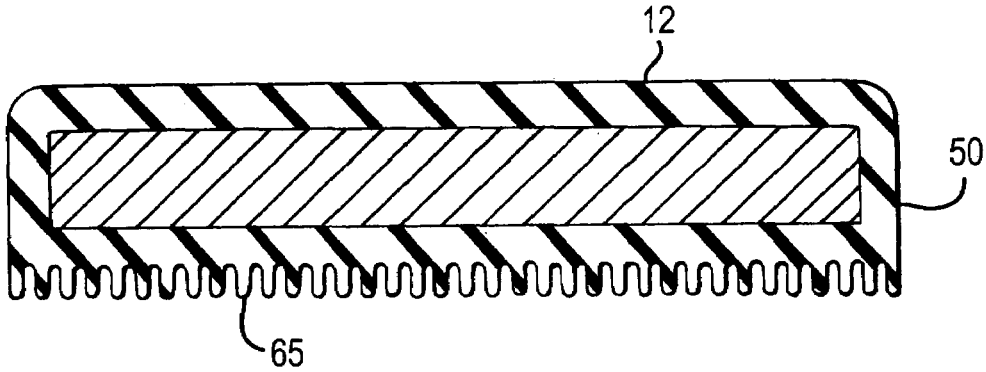

FIG. 12A shows a further embodiment of the present invention wherein the body member and pad member comprise non-chemically compatible materials and the pad member partially encases the body member around two sides of said body member; and FIG. 12B shows a further embodiment of the present invention wherein the body member and pad member comprise non-chemically compatible materials and the pad member fully encases the body member around two sides of said body member.

DETAILED DESCRIPTION OF THE INVENTION

Referring to the sander of the present invention, there is shown a sander 10 having a generally rectangular molded body member 12 including a bottom backing wall or surface 14, which is generally planar, and an upper handle mounting surface 16. Said surfaces 14 and 16 are substantially parallel.

The body member 12 also has a pair of shorter parallel end walls 40, 42 and a pair of longer side walls 44, 46, said walls 40, 42, 44, 46 being upstanding or vertical and essentially continuous around the body member 12 and forming thereby a continuous exterior flat surface 47. In a preferred embodiment, said flat surface has a height that is approximately three-eighths of an inch at the end walls 40, 42 and a height that is approximately three-eighths of an inch at the side walls 44, 46. The end walls 40, 42 and side walls form a rectangular array and a border of the body member 12. The body member is desirably formed of polypropylene material.

Mounted on the handle mounting surface 16 is a universal joint 18, which engages a pole 20. The pole is attached to the universal joint 18 by means of a handle mounting socket 22 which is internally threaded as at 24 to receive a threaded portion 25 of the pole 20.

Mounted on the handle mounting surface 16 of the sander 10 is also a pair of spring wire sandpaper clips 30, 32, said clips 30, 32 being adapted to move between a position slightly distant from the walls 40, 42 of the body member and a position tightly engaged to such end walls, the purpose thereof being to engage a sandpaper strip 34 or abrasive screening (not shown) to the body member 12. Other attachment means to connect the sandpaper or abrasive screening to the body member 12 include clamps, clips, bolts and fastening plates, or a combination thereof.

Figure 1:
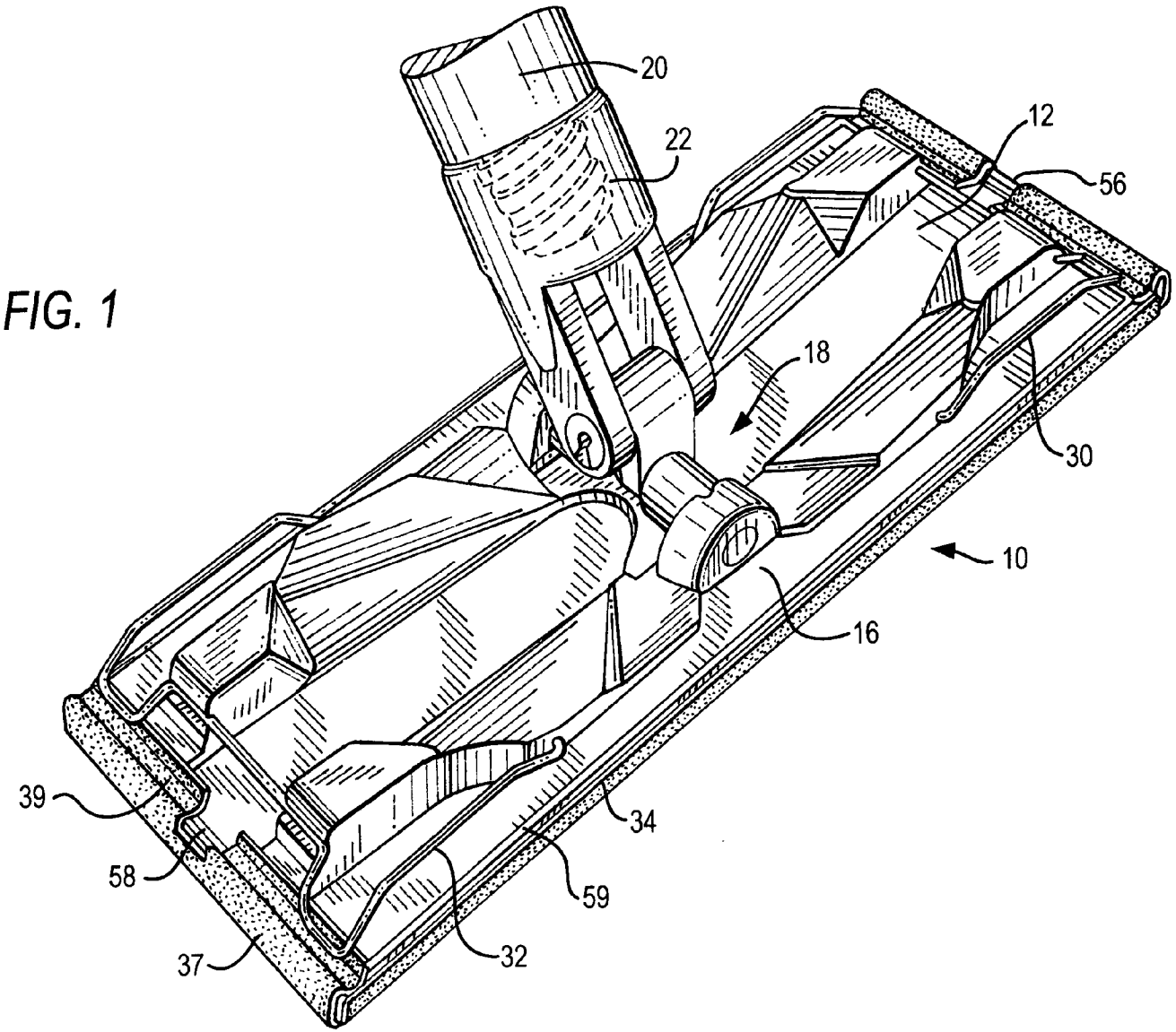
FIG. 1 is a perspective view of the pole sander with the molded elastomeric pad of the present invention.
Figure 2:
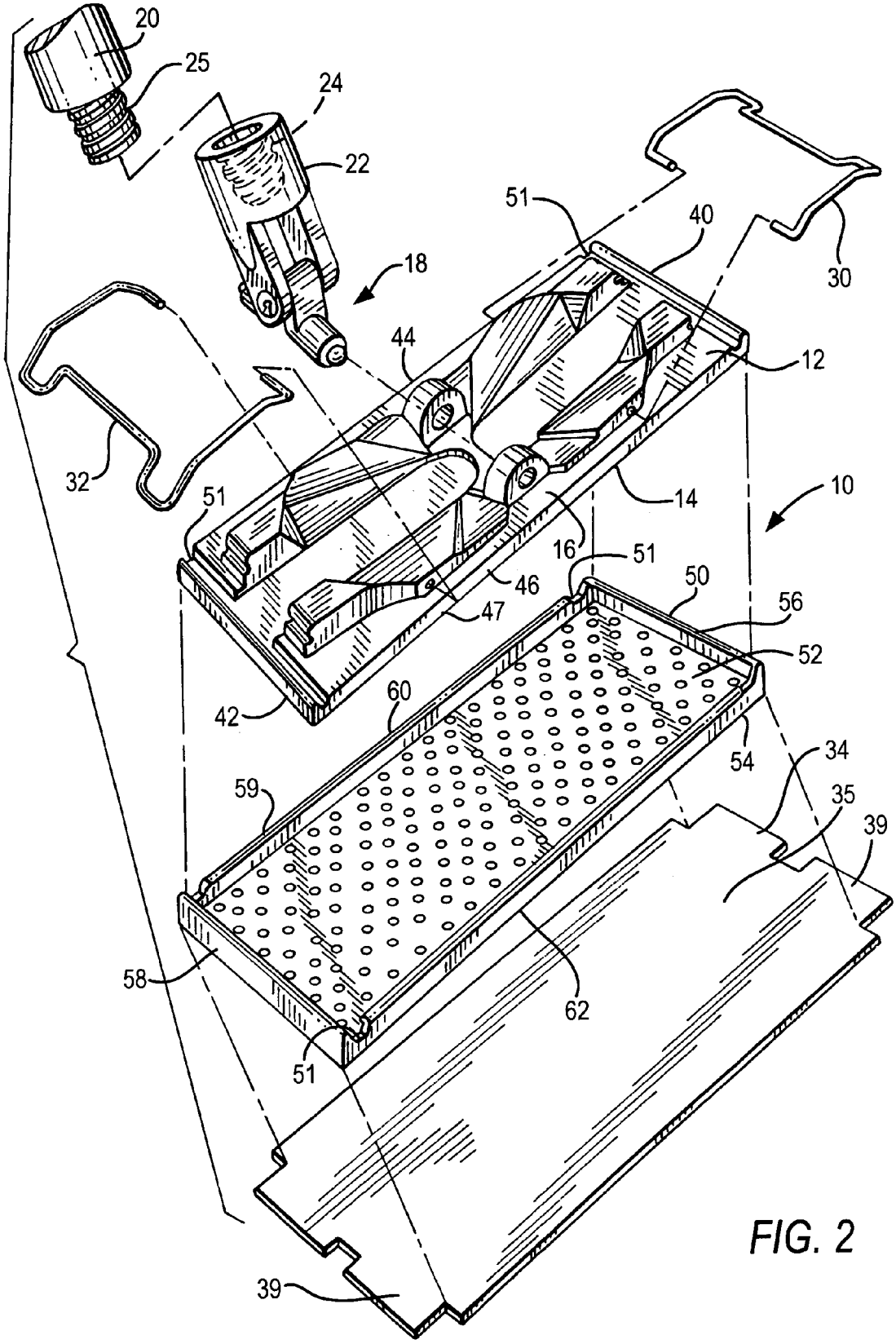
FIG. 2 is an exploded view thereof showing its various components of the pole sander.
Figure 3:
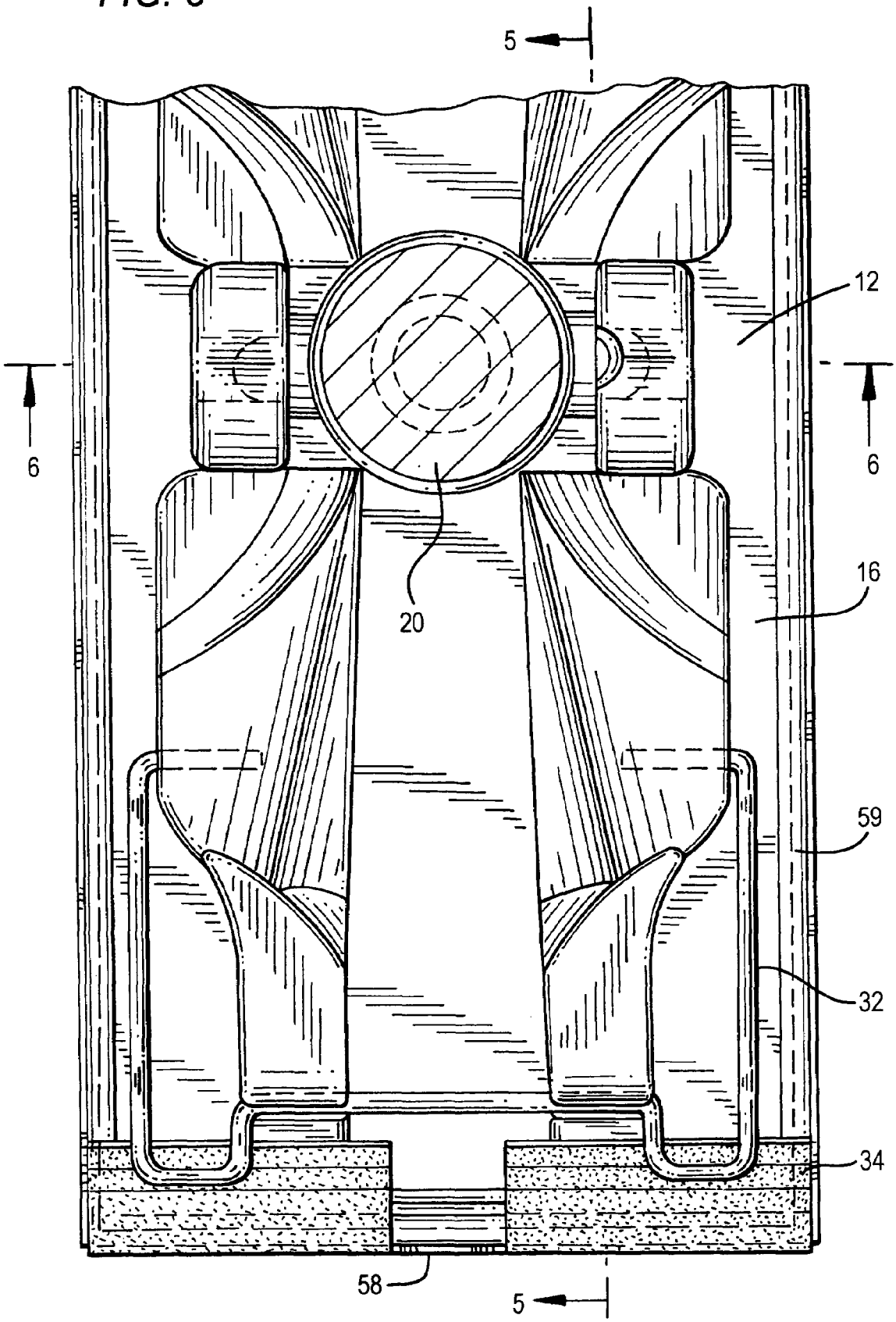
FIG. 3 is a partial top view thereof.

The sandpaper strip 34, best seen in FIG. 2, comprises an interior surface 35 and an exterior surface 37, such exterior surface 37 having a sandpaper face so as to enable a worker to apply sanding action to any surface to which the sander 10 is applied. The strip 34 also has a pair of end tabs 39. When the entire unit is assembled, the tabs 39 fold over and are held in place by the clips 30, 32, as clearly shown in FIG. 1. The strips can be readily removed and replaced when "fresh" sandpaper is needed.

To the extent discussed to this point, this structure is disclosed in U.S. Pat. Nos. 4,516,360 and 4,516,361, the texts of which are incorporated herein by reference.

The novel aspect of the present invention is the interposition of a resilient pad member 50, having certain advantageous features discussed herein, located generally between the body member 12 and the sandpaper strip 34 or other abrasive flat element. In a preferred embodiment, the pad member 50 comprises a generally rectangular shape having an upper planar wall or surface 52 and a lower planar wall or surface 54, which are generally parallel. The pad member preferably has a pair of vertical or upstanding end walls 56, 58 and a pair of vertical or upstanding side walls 60, 62, which in essence form an upstanding wall or border around the entire pad. In a preferred embodiment, the upstanding end walls 56, 58 and upstanding side walls 60, 62 have a height that is approximately one-half inch, but may be varied depending on the desired height of the pad. Accordingly, in the preferred embodiment, the upstanding end walls 56, 58 and upstanding side walls 60, 62 of the pad member have a vertical dimension that is slightly larger than that of the end and side walls 40, 42, 44, 46 of the body member, respectively.

The pad 50 is made of a thermoplastic elastomer material, preferably Santoprene®, thermoplastic rubber, or equivalents thereof, and desirably has a thickness in its main body portion in the range of about 0.030 to 0.250 inches, preferably 0.110 inches. The pad 50 has its internal dimensions only slightly larger than the external dimensions of the body member 12 so that, as noted hereafter, when the body member 12 is located within the confines of the pad member 50, a snug fit is formed between these two members, without any space between them. In other words, as will be discussed, the pad 50 is bonded to and over the body member 12, the pad 50 and body member 12 thus being in a sealed connection to one another.

Figures 4, 5, 5A:
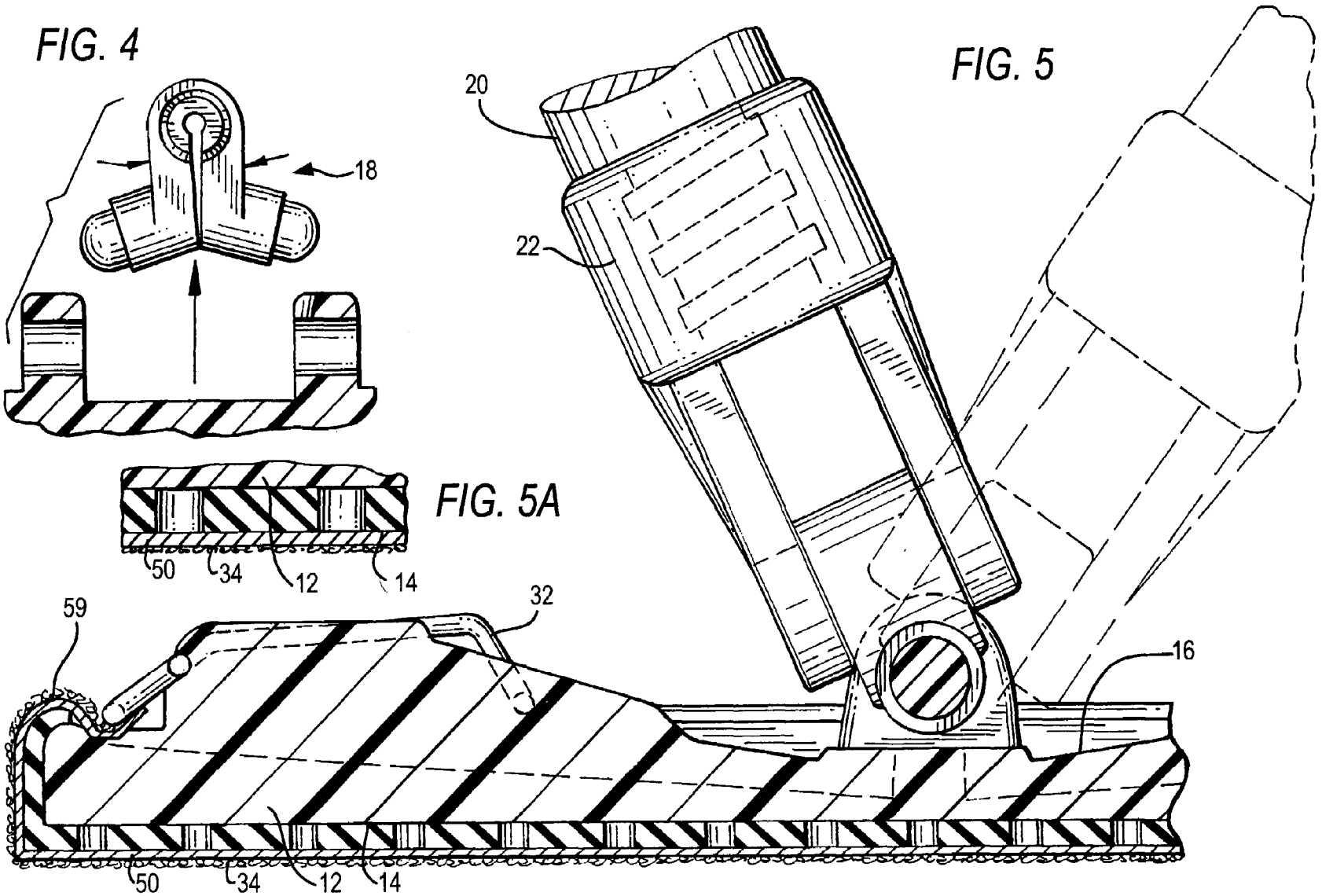
FIG. 4 is a view of the universal joint employed in the pole sander.
FIG. 5 is a cross sectional view taken along the line 5-5 of FIG. 3.
FIG. 5A is an enlarged fragmentary cross sectional view of the sander shown in FIG. 5.
Figures 6, 6A:
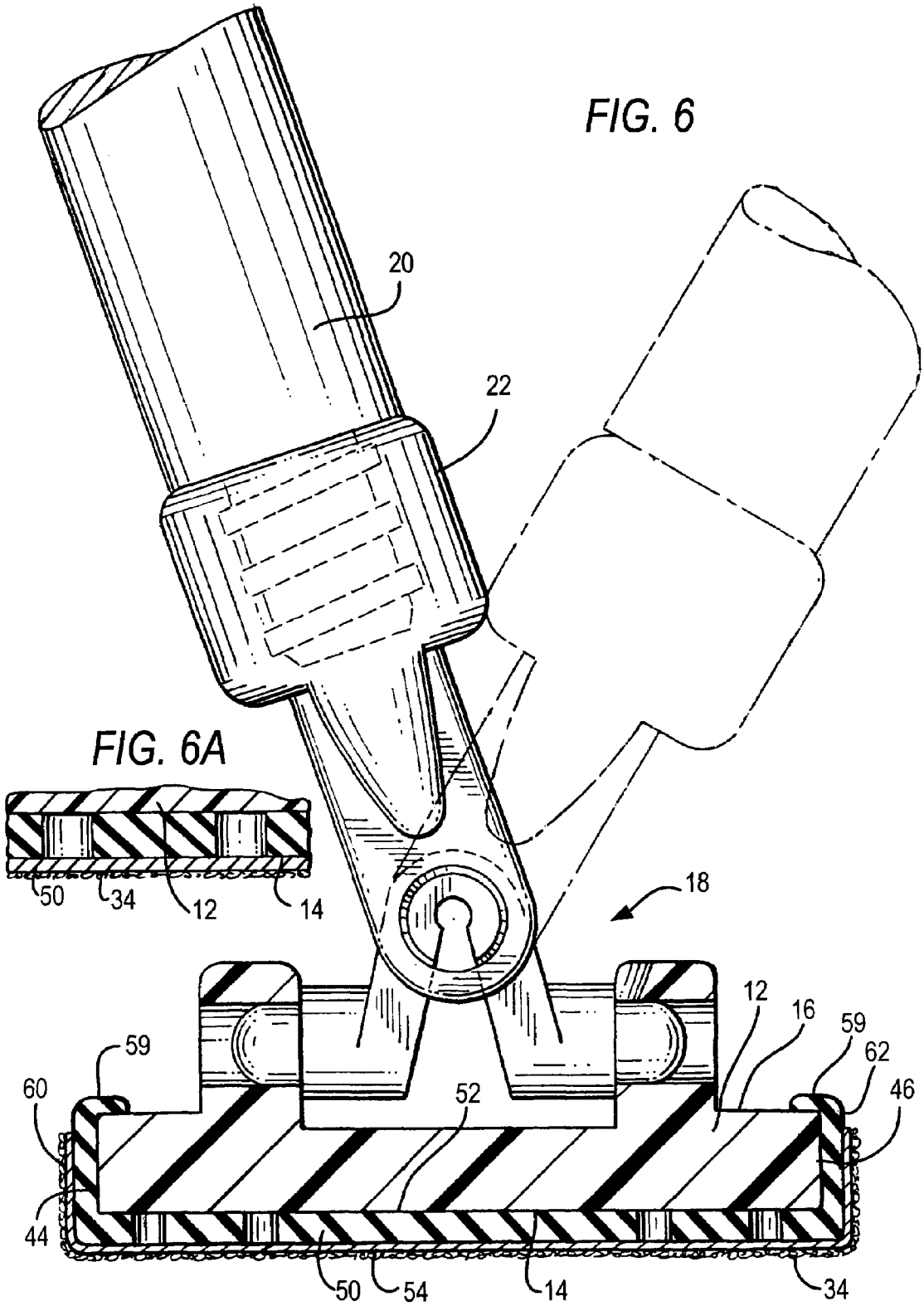
FIG. 6 is a cross sectional view taken along the line 6-6 of FIG. 3.
FIG. 6A is an enlarged fragmentary cross sectional view of the sander shown in FIG. 6

Specifically, the side walls 60, 62 of the pad 50 overlie the side walls 44, 46 of the body member 12, respectively, and the end walls 56, 58 of the pad overlie the end walls 40, 42 of the body member 12, respectively. As best seen in FIGS. 1, 5 and 6, the upstanding walls of the pad 50 essentially cover the side and end walls of the body member, and essentially block them from external side or end view.

As also seen in said figures, the pad 50 has an upper lip 59 located at the top of, and forming an integral part of, the pad walls 56, 58, 62 and 64, essentially running around the entire perimeter of the pad, except for minor gaps 51. As seen in FIGS. 5 and 6, the lip 59 is somewhat bulbous in shape and further overlies and is oriented somewhat inwardly of the walls 40, 42, 44 and 46. The lip 59 enables further frictional engagement between the sandpaper strip 34 and the lip 59, providing for a tighter grip of the sandpaper strip 34 in addition to the grip afforded by the clips 30, 32. Significantly, the lip 59, in combination with the pad member walls 56, 58 60 and 62, yields a thick and desirable side view and end view appearance to the pad, in addition to causing a strong connection between these components.

As a result of the particular durometer, in the range of approximately 30 A to 60 A, and preferably 45 A, and the relative "hardness" of the thermoplastic elastomer utilized in connection with the device as compared to the sponge rubber employed in prior art sanders, which is generally softer than thermoplastic elastomer such as Santoprene®, openings, grooves or other designed configurations which include indentations to the bottom surface of the pad are provided for purposes of providing a softer feeling to the user when the device is in use. Without these openings, grooves or configurations (some examples of which are shown in FIGS. 10A-10E), the pad member 50 would have to be molded substantially thicker to provide for the requisite soft feel to the user, which would be less cost effective. As seen in FIGS. 2, 8, 9 and 10, the pad member itself has a variety of bottom openings, that is, it may be apertured as at 67 and/or may be grooved or configured, as at 65, in order to give it a "spongy" feeling in use and to allow it to "give" against the sandpaper when the sandpaper is applied in a stroking motion to a surface by the sander. When grooves are utilized in connection with the pad member 50, they range in a height of 0.015 to 0.125 inches, preferably 0.060 inches. Further, the apertures 67 around the perimeter of the pad also serve as ejection holes for pushing the molded sander from the mold after it is formed and subsequently cooled. Since the pad 50 is made of a thermoplastic elastomer material, it is generally "soft" and somewhat resilient and therefore the openings are deformable as pressure is applied by the user to the sander in a sanding process. In addition, the pad 50 incorporating thermoplastic elastomer permits sandpaper to proceed below peaks in uneven surfaces having peaks and valleys when said sander is utilized in smoothing out the uneven surface.

Also, the body member and pad member directly molded to one another may form an attachment that is utilized in conjunction with a powered sander, such as a rotary or oscillating sander, wherein the attachment is adapted for connective engagement to a powered sander. The attachment as described provides comparable advantages over current powered sanders with attachments having one or more layers of padding bonded with conventional adhesives.

Figure 7:
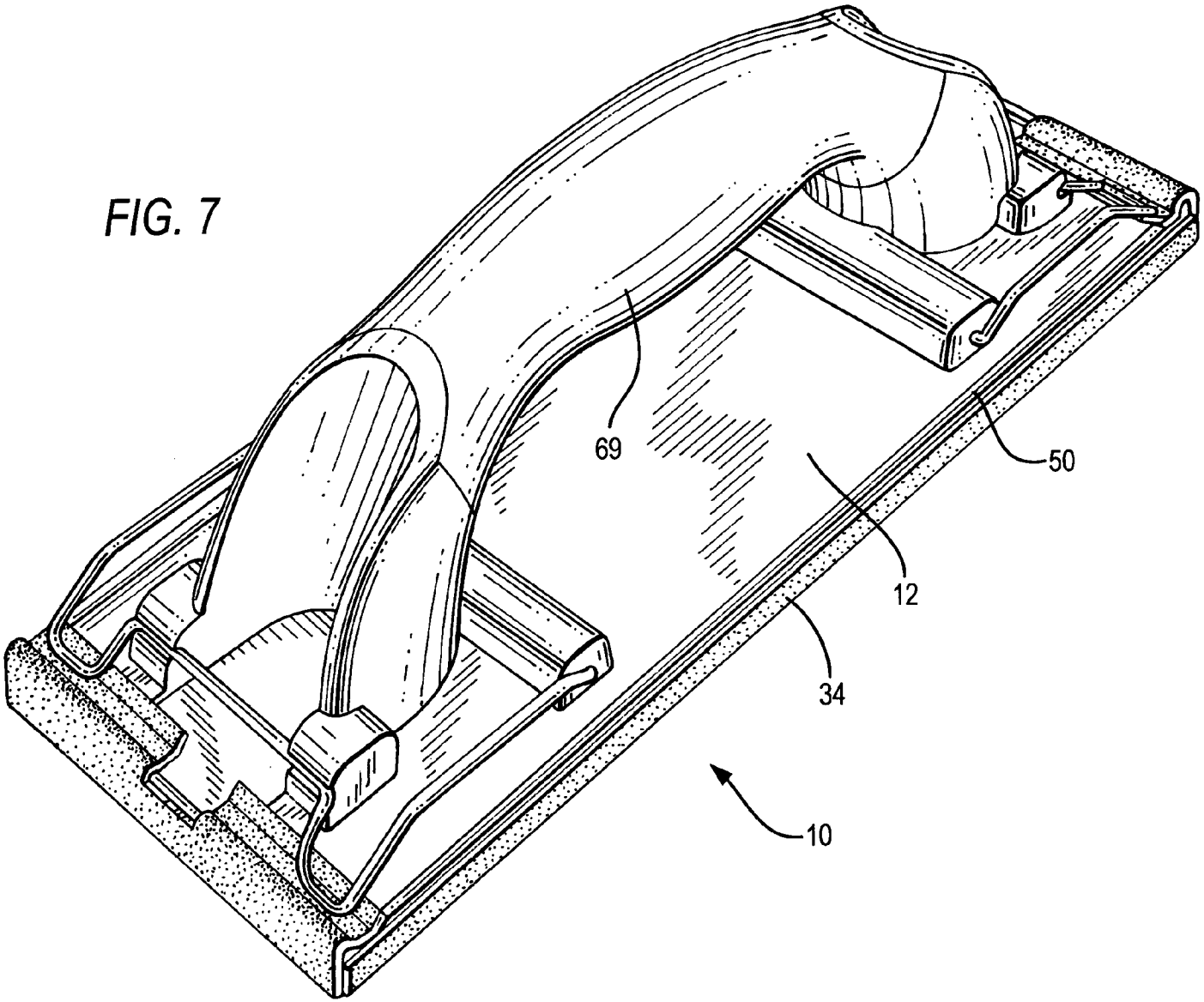
FIG. 7 is a second embodiment of the present invention in the form of a hand sander.
Figure 8:
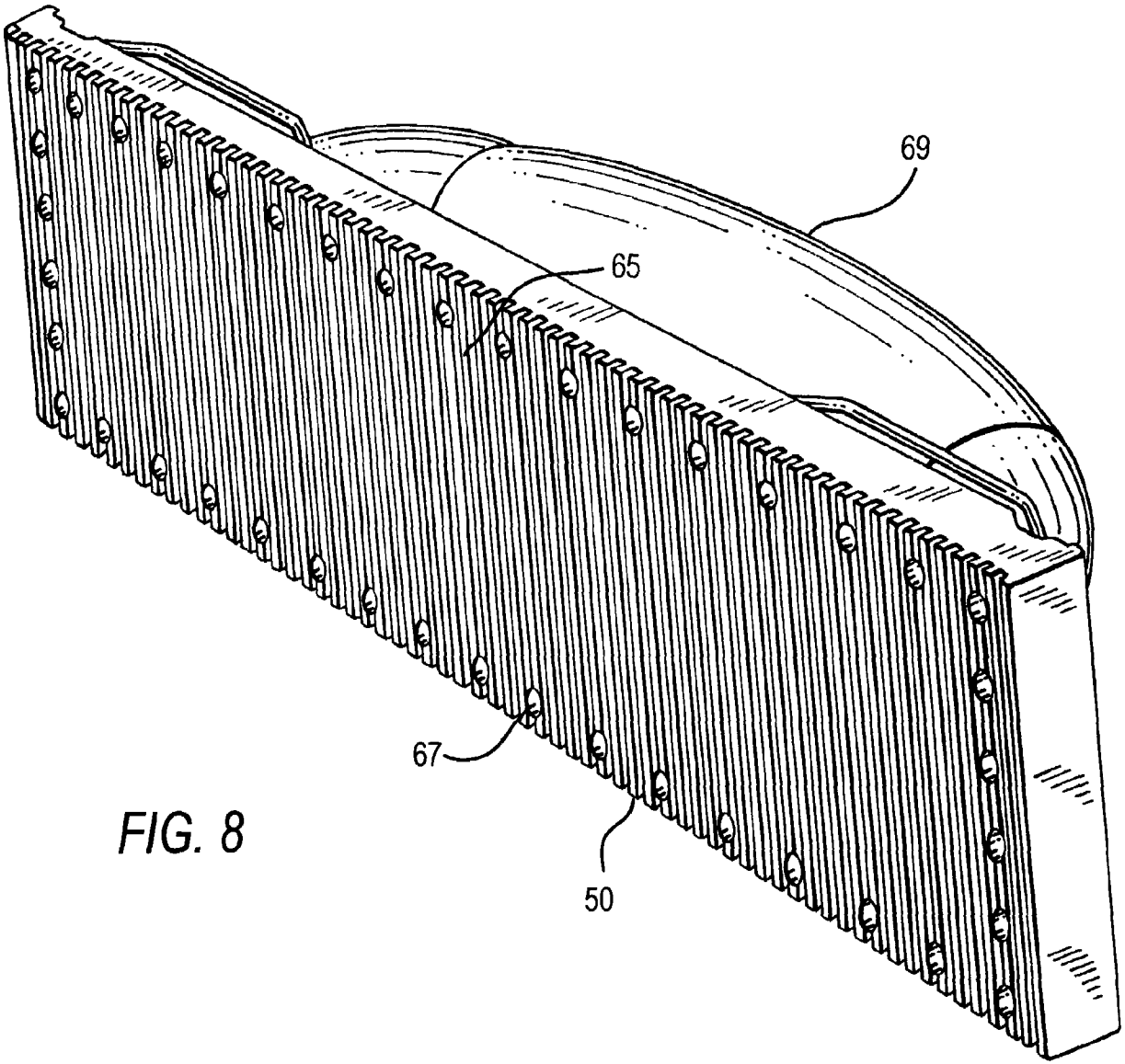
FIG. 8 is a second embodiment of the present invention in the form of a hand sander having a grooved pad member.
Figure 9:
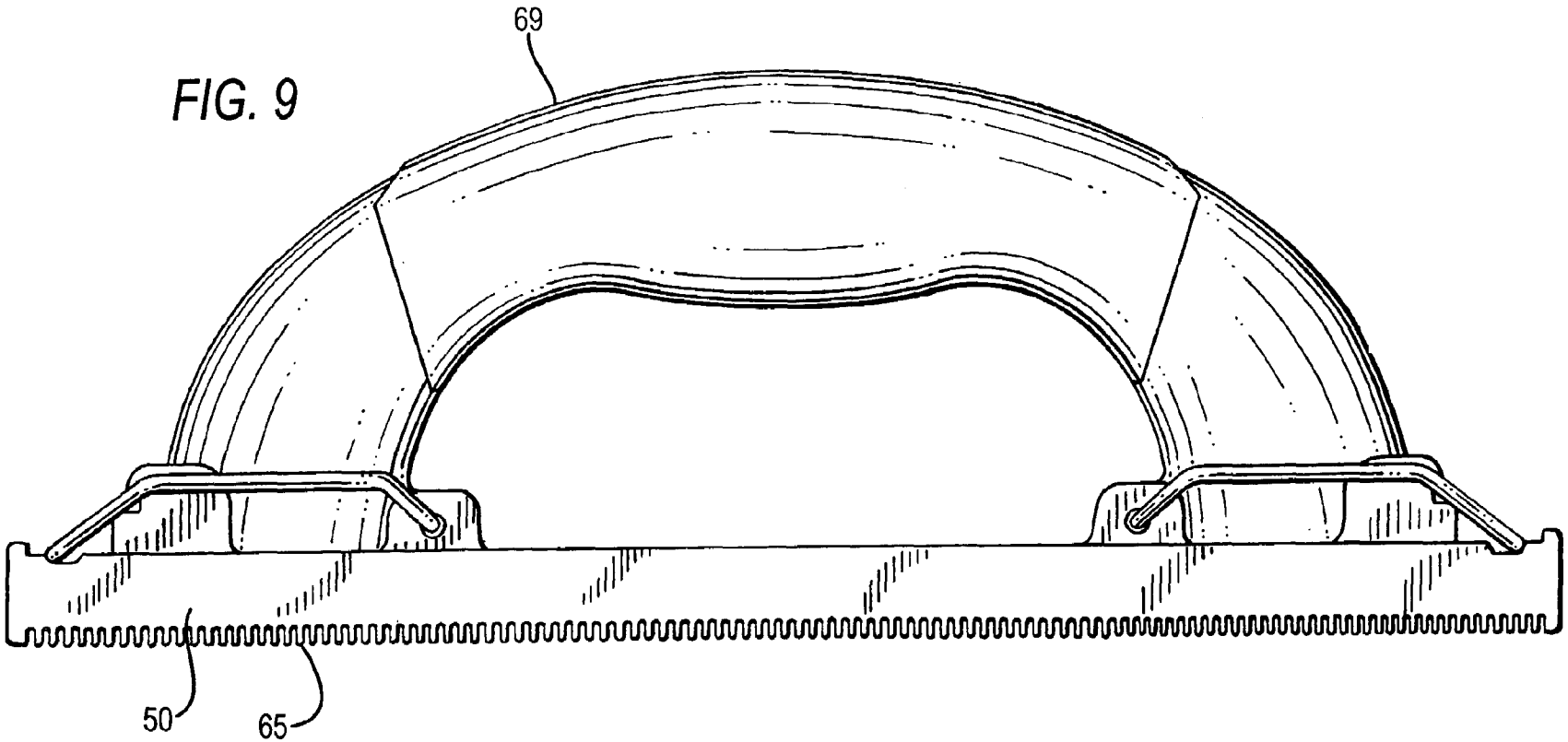
FIG. 9 is a side view of the grooved pad member.
Figure 10A:
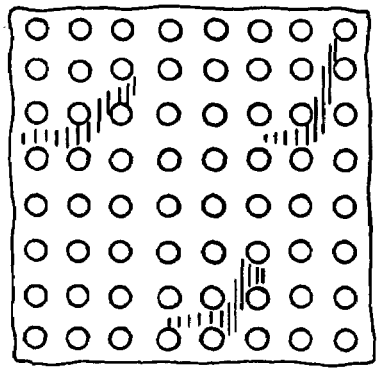
FIGS. 10A-10E are fragmentary views of a number of configurations for the bottom surface of the pad member having openings or grooves therein.
Figure 10B:
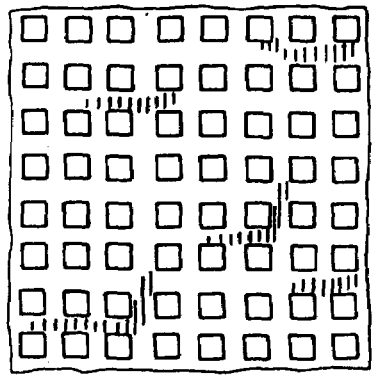
Figure 10C:
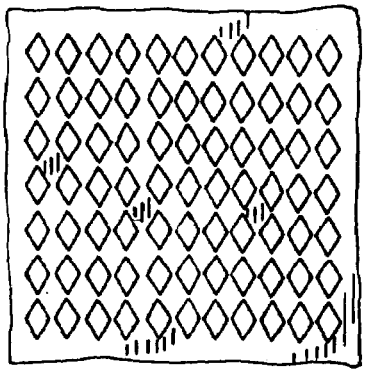
Figure 10D:
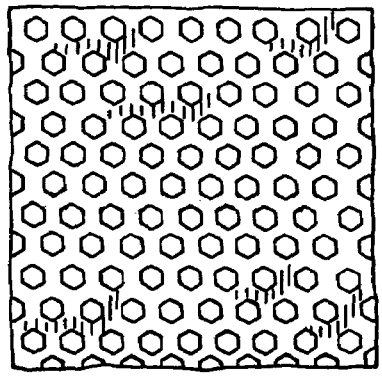
Figure 10E:
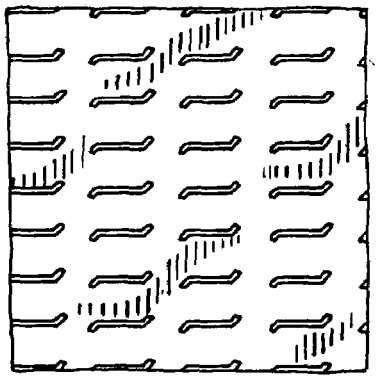

The body member 12 and the pad 50 (as well as the handle 69 and body member 12 shown in FIG. 7) are bonded to one another by a process known as "overmolding" or "co-molding," wherein a thermoplastic elastomer material, preferably Santoprene®, is bonded to the body member 12 that is composed of a compatible substrate using either a single insert or multi-shot process. Specifically, after the polypropylene body member 12 is molded, another mold is used wherein the body member 12 is inserted and a defined space is left vacant into which the thermoplastic elastomer is injected. When the thermoplastic elastomer is injected, it forms the pad member 50 (and handle 22) which is chemically and securely bonded directly to the body member 12, whereby the pad 50 and body member 12 are molecularly and adhesively bonded to one another without the use of a conventional adhesive. The minor gaps 51 shown in the figures are typically where the mold may be sealed. The resulting sander is thus a hard-soft structure that is quite effective in terms of its comfort, non-slip properties, and abrasion-resistant padding and grip.

As in many devices which use the process of overmolding or co-molding of a thermoplastic elastomer to a substrate to create a hard-soft structure, one critical challenge to overcome is poor adhesion of thermoplastic elastomer to the substrate, which reveals itself in peeling, curling, fraying, or delamination of the material layers. Preferably, in the context of the sander, Santoprene® has been found to form an effective pad member 50 when bonded to a polypropylene body member 12. Of course, other thermoplastic elastomers or thermoplastic rubbers and compatible substrates, such as styrene and ABS, may be used in practicing the invention.

Figure 11:
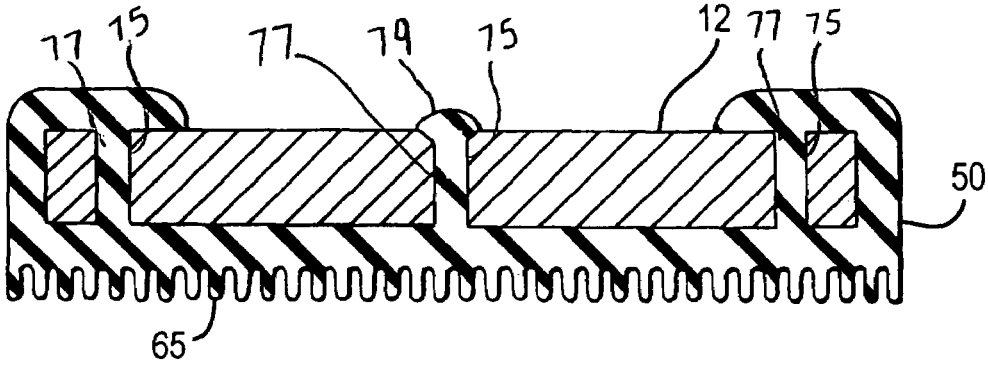
FIG. 11 shows another embodiment of the present invention wherein the body member and pad member comprise non-chemically compatible materials and the pad member is attached to said body member through inserts which pass into spaces provided in said body member.

In FIG. 11 there is shown a body member 12 composed of a non-plastic material, such as metal, that is not chemically compatible with a thermoplastic elastomer or thermoplastic rubber. In this embodiment, in order to attach said pad 50 to said body member 12 comprising the non compatible material, one or more spaces 75 are provided in the body member 12 such that the thermoplastic elastomer can be injected in its liquid form through said spaces 75. After the thermoplastic material is cooled during the production process, the thermoplastic elastomer forms the pad member 50 with extensions 77 having one or more capped inserts 79 that mechanically attach said pad member 50 to said body member 12. Alternatively, extensions or rivets (not shown) may be provided on the body member 12 itself around which said pad member 50 (formed by the thermoplastic elastomer material) having openings may be attached to the body member 12. In these embodiments, if desired, the pad member 50 may formed so as to be able to be "peeled" away from said metallic body member. Furthermore, if desired, the pad member 50 may be produced separately from said body member and applied to the body member thereafter also depending on the particular configuration. Likewise, as shown in FIGS. 12A and 12B, when non-chemically compatible materials comprise the body member 12 and pad member 50, the pad member is constructed to partially surround or encase the body member like a glove on the top, bottom and at least two sides. Moreover, depending on the desired orientation and connectivity between the pad member 50 and body member 12, it is also possible to form a pad member 50 which may be attached to the side ends of the body member 50 (rather than the front and rear ends as shown in FIGS. 11, 12A and 12B). Of course, other embodiments may be constructed wherein said pad member 50 may be attached at all four sides of the body member 12 as well.

Although the invention is described in terms of particular embodiments, it is to be understood that the embodiments are merely illustrative of an application of the principles of the invention. Numerous modifications may be made and other arrangements may be devised without departing from the spirit and scope of the invention.

What is claimed is:

1. A sander for applying sandpaper or abrasive screening to a surface, the sander comprising:

a body member having upstanding walls and a bottom wall;

a pad member made of thermoplastic material having upstanding walls and an upper wall;

attachment means on the body member for detachably joining sandpaper or abrasive screening along the bottom wall of the pad member;

the upstanding walls and the upper wall of the pad member being co-molded about and overlying the upstanding walls and bottom wall of the body member respectively;

the upstanding walls of the pad member having a top portion that defines a substantially immovable upper lip which is substantially continuous and which overlies all of the upstanding walls of said body member; and the body member being made of a substrate which is chemically compatible with and molecularly bonded to said pad member without the use of an adhesive.

2. A sander as set forth in claim 1, wherein said attachment means retains said sandpaper or abrasive screening against said lip, the lip thereby being in direct contact with said sandpaper or abrasive screening to enable further frictional engagement between said lip and said sandpaper or abrasive screening.

3. A sander as set forth in claim 2, wherein said lip is bulbous, curved and flexible, providing greater frictional contact when said sandpaper or abrasive screening is engaged to said sander pressed against said lip.

4. A sander as set forth in claim 1, wherein the pad member is made of thermoplastic elastomer material.

5. A sander as set forth in claim 4, wherein said thermoplastic elastomer material is Santoprene.

6. A sander as set forth in claim 1, wherein the pad member is made of thermoplastic rubber material.

7. A sander as set forth in claim 1, wherein the substrate is a hard plastic material.

8. A sander as set forth in claim 7, wherein substrate is polypropylene and said pad member is made of thermoplastic elastomer material.

9. A sander as set forth in claim 2, wherein said pad member has multiple openings on its bottom surface.

10. A sander as set forth in claim 9, wherein said openings are grooves.

11. A sander as set forth in claim 9, wherein said openings are apertures.

12. A sander as set forth in claim 2, wherein said pad member comprises a design having a plurality of indentations on the bottom surface of the pad.

13. A sander as set forth in claim 1, wherein said body member has an upper wall and said attachment means comprises a clip located on said upper wall.

14. A sander as set forth in claim 1, wherein said body member has an upper wall and said attachment means comprises a clamp located on said upper wall.

15. A sander as set forth in claim 1, wherein said body member has an upper wall and said attachment means comprises a fastening plate located on said upper wall.

16. A sander as set forth in claim 1, wherein said upstanding walls of said pad have a height that is approximately one-half inch.

17. A sander as set forth in claim 16, wherein said upstanding walls of said body member have a height that is approximately three-eighths of an inch.

18. A sander for applying sandpaper or abrasive screening to a surface, the sander comprising:

a body member made of hard plastic having continuous vertical walls and a flat bottom surface, the vertical walls being essentially perpendicular to the bottom surface;

a pad member made of a thermoplastic elastomer that is chemically compatible to said hard plastic, said pad member having (a) continuous vertical walls of a first thickness, (b) an upper edge on said vertical walls that defines a bulbous, curved and substantially immovable lip of a second thickness that is greater than said first thickness, and (c) a flat upper surface, the vertical walls being essentially perpendicular to the upper surface;

the vertical walls and the lip being co-molded about and overlying the vertical walls, and the upper surface of the pad member being co-molded about and overlying the bottom surface of the body member such that said vertical walls and lip of the pad member block from view along a line of sight parallel to said bottom surface and upper surface of the walls of the body member in side and end views, giving said sander a thick, one-piece appearance.

19. A sander as set forth in claim 18, further comprising a fastener to secure said sandpaper or abrasive screening to said sander wherein when said sandpaper or abrasive screening is fastened to said sander there is increased frictional contact between said sandpaper or abrasive screening and said sander as a result of said lip.

20. A sander as set forth in claim 18, wherein said hard plastic is polypropylene.

21. A sander as set forth in claim 18, wherein said hard plastic is styrene.

22. A sander as set forth in claim 18, wherein said pad member contains a plurality of indentations which permit said pad member to become more deformed and thereby permit sandpaper or abrasive screening to proceed below peaks in uneven surfaces when said sander is in use.

23. A sander as set forth in claim 18, wherein said vertical walls of said pad member have a vertical dimension that is greater than a vertical dimension of said vertical walls of said body member.

24. A sander as set forth in claim 18, wherein said bottom surface of said pad member comprises openings.

25. A sander as set forth in claim 24, wherein said openings are deformable.

26. A sander for applying sandpaper or abrasive screening to a surface, the sander comprising:

a body member comprising polypropylene, said body member having upstanding walls and a substantially flat bottom wall;

a pad member comprising thermoplastic elastomer material, said pad member having an upper wall, a bottom wall with a plurality of deformable indentations, a plurality of vertical walls connected to said upper wall and bottom wall, and an upper edge at said plurality of vertical walls that defines a curved, deformable lip that is substantially immovable;

at least one fastener located on the body member to detachably join sandpaper or abrasive screening along the bottom wall of said pad member and in pressing engagement against said lip of said pad member;

wherein said plurality of vertical walls and said lip of said pad member are molded to and overlie said upstanding walls of said body member, and said upper wall of said pad member co-molded to and overlies said substantially flat bottom wall of said body member.

* * * * *